US008655231B2

(12) United States Patent
Brown

(10) Patent No.: US 8,655,231 B2
(45) Date of Patent: Feb. 18, 2014

(54) ELECTROPHOTOGRAPHIC DEVELOPER TONER REPLENISHMENT APPARATUS

(75) Inventor: Kenneth Joseph Brown, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 335 days.

(21) Appl. No.: 13/181,701

(22) Filed: Jul. 13, 2011

(65) Prior Publication Data

US 2013/0017000 A1 Jan. 17, 2013

(51) Int. Cl.
*G03G 15/08* (2006.01)

(52) U.S. Cl.
USPC ..... 399/255; 399/256; 399/260

(58) Field of Classification Search
USPC ..... 399/254, 255, 256, 258, 260, 263
See application file for complete search history.

(56) References Cited

U.S. PATENT DOCUMENTS

| | | | | |
|---|---|---|---|---|
| 4,235,194 | A * | 11/1980 | Wada et al. | 399/138 |
| 4,519,696 | A | 5/1985 | Bruyndonckx | |
| 4,825,244 | A * | 4/1989 | Hediger | 399/255 |
| 4,928,144 | A * | 5/1990 | Kasahara et al. | 399/228 |
| 4,951,094 | A * | 8/1990 | Bell et al. | 399/260 |
| 5,189,474 | A * | 2/1993 | Miya et al. | 399/255 |
| 5,682,584 | A * | 10/1997 | Hattori et al. | 399/255 |
| 6,498,908 | B2 | 12/2002 | Phillips | |
| 6,608,641 | B1 | 8/2003 | Alexandrovich et al. | |
| 6,934,493 | B2 * | 8/2005 | Murakami | 399/258 |
| 7,561,833 | B2 * | 7/2009 | Stelter et al. | 399/258 |
| 7,792,467 | B2 | 9/2010 | Stelter et al. | |
| 2006/0133870 | A1 | 6/2006 | Ng et al. | |

FOREIGN PATENT DOCUMENTS

| | | |
|---|---|---|
| GB | 2098095 | 4/1982 |

OTHER PUBLICATIONS

U.S. Appl. No. 12/847,143, filed Jul. 30, 2010, Brown, et al.

* cited by examiner

*Primary Examiner* — Robert Beatty
(74) *Attorney, Agent, or Firm* — Christopher J. White; Raymond L. Owens

(57) ABSTRACT

A toner replenishment apparatus for a dry electrophotographic (EP) printer includes a rotatable transport subsystem in the developer. The subsystem includes an elongated housing with a feed port and various apertures arranged along its length. A channel within the housing receives toner from the toner supply through the feed port. A toner transport member in the channel moves toner received through the feed port to the apertures, and a developer-mixing member attached to the outside of the housing mixes toner and carrier particles in the developer. The toner transport member is stationary or rotates at a different angular velocity than the housing. When the rotation of the transport subsystem brings a selected one of the apertures below the center of the housing, toner passes through the selected aperture into the developer in the sump, and is mixed into the developer by the developer-mixing member as the transport subsystem rotates.

17 Claims, 6 Drawing Sheets

ELECTROPHOTOGRAPHIC DEVELOPER TONER REPLENISHMENT APPARATUS

FIELD OF THE INVENTION

This invention pertains to the field of electrophotographic printing and more particularly to replenishing developer in an electrophotographic printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image"). The photoreceptor retains the latent image, e.g., on its surface or under a protective ceramic overcoat.

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

FIG. 2 shows an embodiment of a typical toning station 23 for bringing toner particles into the vicinity of photoreceptor 25. This station uses two-component developer, also called multi-component developer. Developer 235 includes toner particles and magnetic carrier particles. Belt photoreceptor 25 is adjacent to toning station 23, which includes toning roller 210, feed roller 220, and sump 230. Sump 230 contains developer 235. Feed roller 220 includes protrusions 225 for carrying developer from sump 230 to toning roller 210. Metering skive 214 is spaced apart from toning roller 210 to permit an appropriate amount of developer to pass to toning zone 217, in which toner is transported to photoreceptor 25. Mixer 237 rotates to tribocharge and mix developer 235. An example of a system using a feed roller and mixing augers is given in U.S. Pat. No. 7,792,467, the disclosure of which is incorporated herein by reference.

Toner particles are attracted to magnetic carrier particles by electrostatic forces developed by tribocharging in sump 230. As toner particles and carrier particles are moved against each other by mixer 237, they develop opposite charges and are thus attracted to each other. The toning station 23 brings developer into proximity with the latent image on the photoreceptor. A magnetic field is applied to the magnetic carrier particles to cause them to lift towards photoreceptor 25. The toner particles attracted to the carrier particles are thus brought closer to the latent image. This reduces the electrostatic force required to transfer toner particles from the developer to the latent image, and thus provides a visible image which more completely fills the toner areas of the latent image.

Various schemes have been proposed for mixing toner and carrier particles to provide effective development, especially when fresh toner is added to replace toner that has been transferred to the photoreceptor ("toner replenishment"). The above-referenced '467 patent uses augers in the sump to mix developer. Other systems add fresh toner to the end of a return channel where depleted developer empties into a sump or auger racetrack. However, this can lead to dusting, a phenomenon in which relatively uncharged or relatively low-charged toner particles become airborne due to the high kinetic energy imparted to them by mixer 237, e.g., a mixing auger or paddle.

In some toning stations, replenishment toner is supplied to the toning station 23 through tube 238 that has either holes or slots. This tube 238 is usually disposed over the sump 230, and an appropriate amount of replenishment toner 239 is dropped into the toning station sump 230 at the point where toner-carrier mixing occurs. As this mixing area is usually diffusive, a considerable amount of agitation of the developer may be present in the toning station sump 230. The action of dropping the toner onto the surface of the toning station sump 230 can cause undesired effects. Toner, when released from the replenisher tube 238, can be moved by any air currents within the toning station 23 and deposited on unwanted locations within the toning station 23. The toner can also travel out of the toning station 23, depositing dust on other subsystems in the electrophotographic module and reducing image quality.

There is a need, therefore, for an improved way of replenishing toner in a multi-component dry electrophotographic printer.

SUMMARY OF THE INVENTION

According to an aspect of the present invention, there is provided a toner replenishment apparatus for a dry electrophotographic (EP) printer, comprising:

a. a sump for holding developer, the developer including toner particles and magnetic carrier particles;

b. a toner supply;

c. a rotatable transport subsystem at least partially in the developer in the sump and including:

i. an elongated housing including a feed port and a plurality of apertures arranged along its length;

ii. a channel within the housing adapted to receive toner from the toner supply through the feed port;

iii. a toner transport member in the channel for moving toner received through the feed port to the apertures, wherein the toner transport member is stationary or rotates at a different angular velocity than the housing; and iv. a developer-mixing member attached to the outside of the housing for mixing toner and carrier particles in the developer;

d. so that when the rotation of the transport subsystem brings a selected one of the apertures below the center of the housing, toner passes through the selected aperture into the developer in the sump, and is mixed into the developer by the developer-mixing member as the transport subsystem rotates.

According to another aspect of the present invention, there is provided a toner replenishment apparatus for a dry electrophotographic (EP) printer, comprising:

a. a sump for holding developer, the developer including toner particles and magnetic carrier particles;

b. a toner supply;

c. a rotatable transport subsystem at least partially in the developer in the sump and including:

i. an elongated housing including a feed port and one or more slit(s) arranged along its length;

ii. a channel within the housing adapted to receive toner from the toner supply through the feed port, wherein the one or more slit(s) together span at least 25% of the length of the channel;

iii. a toner transport member in the channel for moving toner received through the feed port to the slit(s), wherein the toner transport member is stationary or rotates at a different angular velocity than the housing; and iv. a developer-mixing member attached to the outside of the housing for mixing toner and carrier particles in the developer;

d. so that when the rotation of the transport subsystem brings a selected one of the slit(s) below the center of the housing, toner passes through the selected slit into the developer in the sump, and is mixed into the developer by the developer-mixing member as the transport subsystem rotates.

According to another aspect of the present invention, there is provided a toner replenishment apparatus for a dry electrophotographic (EP) printer, comprising:

a. a sump for holding developer, the developer including toner particles and magnetic carrier particles;

b. a toner supply;

c. a rotatable transport subsystem at least partially in the developer in the sump and including:

i. an elongated housing including a feed port, a developer port, and a plurality of apertures arranged along its length;

ii. a channel within the housing adapted to receive toner from the toner supply through the feed port and including a plurality of delivery apertures arranged along its length;

iii. a toner transport member in the channel for moving toner received through the feed port to the delivery apertures, wherein the toner transport member is stationary or rotates at a different angular velocity than the housing;

iv. a mixing chamber in the housing adapted to receive toner from the channel through one or more of the delivery apertures and developer from the sump through the developer port, so that the rotation of the transport subsystem mixes the received toner into the received developer;

v. a developer-mixing member attached to the outside of the housing for mixing toner and carrier particles in the developer;

d. so that when the rotation of the transport subsystem brings a selected one of the apertures below the center of the housing, mixed developer from the mixing chamber passes through the selected aperture into the developer in the sump, and is mixed into the developer by the developer-mixing member as the transport subsystem rotates.

An advantage of this invention is that it reduces dusting by reducing the exposure of fresh toner to the atmosphere before it is mixed into depleted developer. It distributes toner more evenly through the developer, permitting the toner to tribocharge more rapidly. This further reduces dusting, and reduces the probability of forming toner agglomerates. More rapid charging also reduces the probability of dusting off the toning roller after developer is drawn out of the sump by the toning roller. This also provides more consistent toning, improving image quality. Furthermore, various embodiments effectively incorporate the replenished toner in the developer in the sump to provide a more favorable charge distribution of toner. In this charge distribution, more toner has the correct sign to be attracted to carrier particles, so dusting is reduced.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
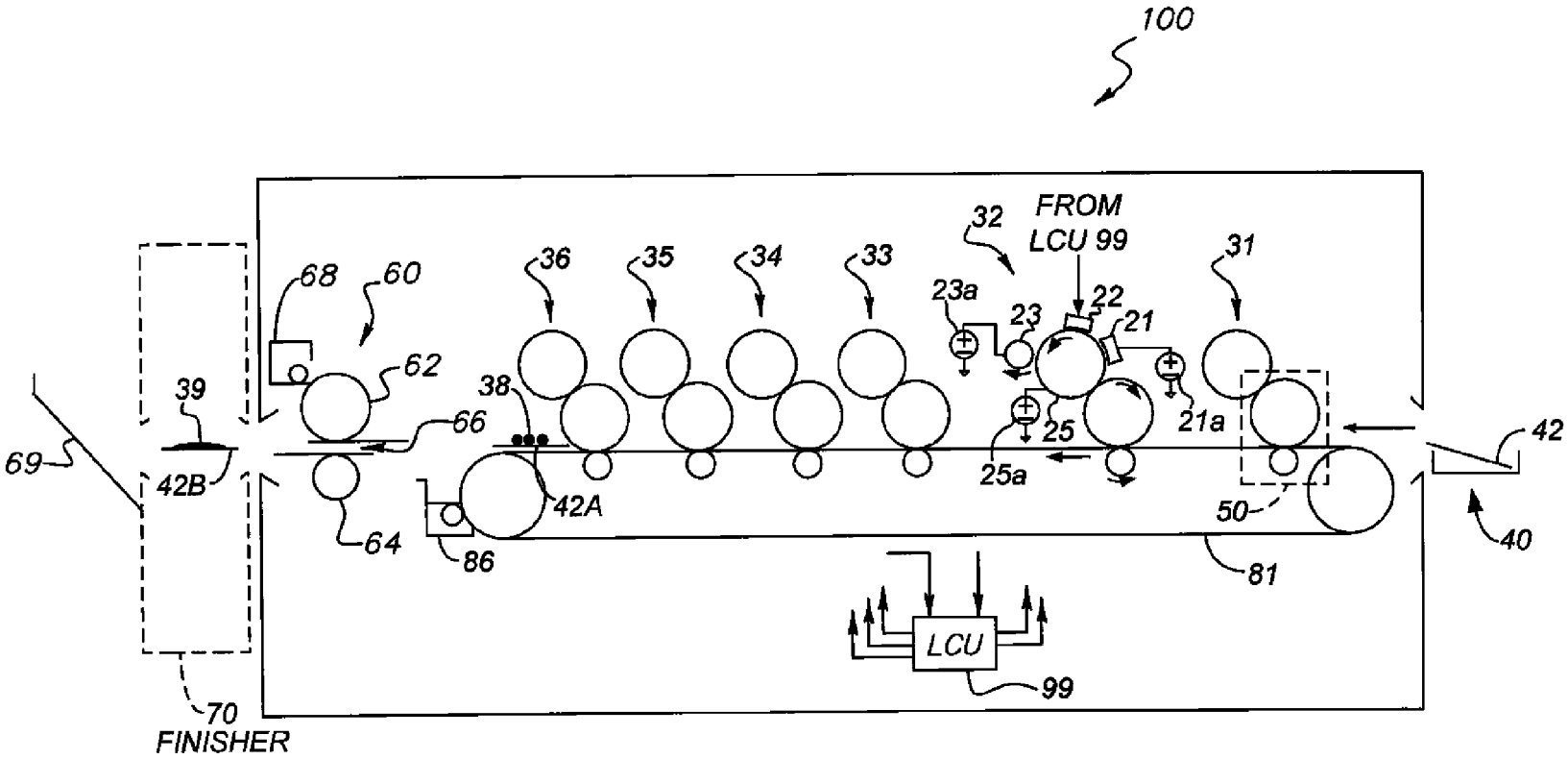
FIG. 1 is an elevational cross-section of an electrophotographic reproduction apparatus suitable for use with various embodiments.
Figure 2:
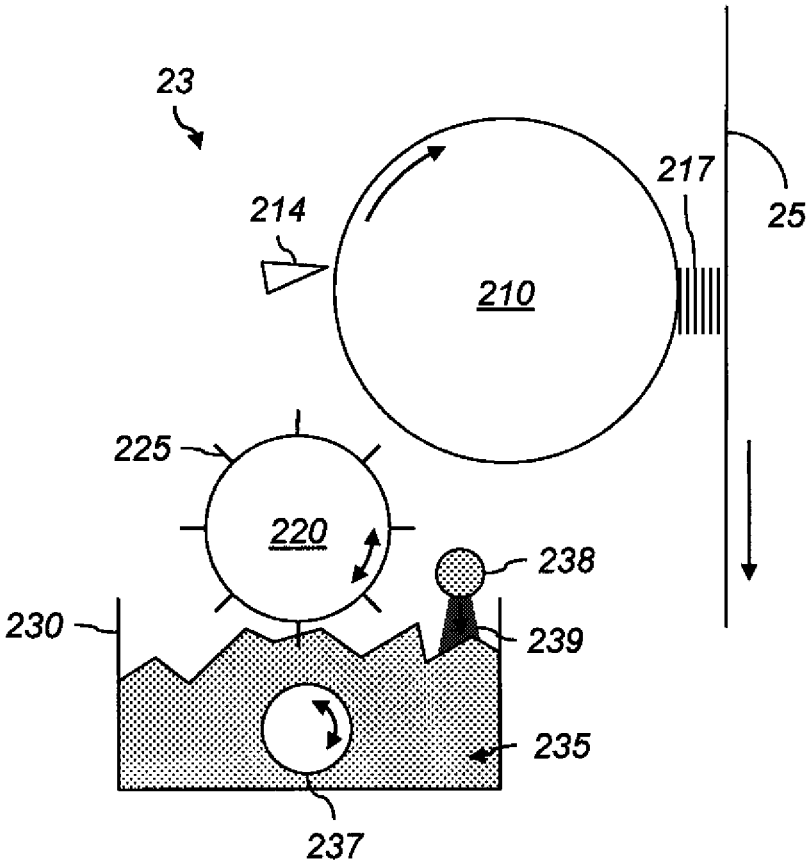
FIG. 2 (PRIOR ART)
FIG. 2 shows an embodiment of a conventional development station.

The attached drawings are for purposes of illustration and are not necessarily to scale.

DETAILED DESCRIPTION OF THE INVENTION

As used herein, the terms "parallel" and "perpendicular" have a tolerance of ±10°.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color onto a receiver. A printer can also produce selected patterns of toner on a receiver, which patterns (e.g., surface textures) do not correspond directly to a visible image. The DFE receives input electronic files (such as Postscript command files) composed of images from other input devices (e.g., a scanner, a digital camera). The DEE can include various function processors, e.g., a raster image processor (RIP), image positioning processor, image manipulation processor, color processor, or image storage processor. The DEE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g., the electrophotographic process) to provide known, consistent color reproduction characteristics. The color management system can also provide known color reproduction for different inputs (e.g., digital camera images or film images).

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

In an embodiment of an electrophotographic modular printing machine useful with various embodiments, e.g., the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with various embodiments. Printer 100 is adapted to produce print images, such as single-color (monochrome), CMYK, or hexachrome (six-color) images, on a receiver (multicolor images are also known as "multi-component" images). Images can include text, graphics, photos, and other types of visual content. One embodiment involves printing using an electrophotographic print engine having six sets of single-color image-producing or printing stations or modules arranged in tandem, but more or fewer than six colors can be combined to form a print image on a given receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, 36, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each printing module 31, 32, 33, 34, 35, 36 includes various components. For clarity, these are only shown in printing module 32. Around photoreceptor 25 are arranged, ordered by the direction of rotation of photoreceptor 25, charger 21, exposure subsystem 22, and toning station 23.

In the EP process, an electrostatic latent image is formed on photoreceptor 25 by uniformly charging photoreceptor 25 and then discharging selected areas of the uniform charge to yield an electrostatic charge pattern corresponding to the desired image (a "latent image"). Charger 21 produces a uniform electrostatic charge on photoreceptor 25 or its surface. Exposure subsystem 22 selectively image-wise discharges photoreceptor 25 to produce a latent image. Exposure subsystem 22 can include a laser and raster optical scanner (ROS), one or more LEDs, or a linear LED array.

After the latent image is formed, charged toner particles are brought into the vicinity of photoreceptor 25 by toning station 23 and are attracted to the latent image to develop the latent image into a visible image. Note that the visible image may not be visible to the naked eye depending on the composition of the toner particles (e.g. clear toner). Toning station 23 can also be referred to as a development station. Toner can be applied to either the charged or discharged parts of the latent image.

After the latent image is developed into a visible image on photoreceptor 25, a suitable receiver 42 is brought into juxtaposition with the visible image. In transfer station 50, a suitable electric field is applied to transfer the toner particles of the visible image to the receiver 42 to form the desired print image on the receiver. The imaging process is typically repeated many times with reusable photoreceptors.

The receiver 42 is then removed from its operative association with photoreceptor 25 and subjected to heat or pressure to permanently fix ("fuse") the print image to the receiver 42. Plural print images, e.g. of separations of different colors, are overlaid on one receiver before fusing to form a multicolor print image on the receiver 42.

Each receiver 42, during a single pass through the six printing modules 31, 32, 33, 34, 35, 36, can have transferred in registration thereto up to six single-color toner images to form a pentachrome image. As used herein, the term "hexachrome" implies that in a print image, combinations of various of the six colors are combined to form other colors on the receiver 42 at various locations on the receiver 42. That is, each of the six colors of toner can be combined with toner of one or more of the other colors at a particular location on the receiver 42 to form a color different than the colors of the toners combined at that location. In an embodiment, printing module 31 forms black (K) print images, 32 forms yellow (Y) print images, 33 forms magenta (M) print images, 34 forms cyan (C) print images, 35 forms light-black (Lk) images, and 36 forms clear images.

In various embodiments, printing module 36 forms a print image using a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 36. Print image 38 on receiver 42A includes unfused toner particles.

Subsequent to transfer of the respective print images, overlaid in registration, one from each of the respective printing modules 31, 32, 33, 34, 35, 36, receiver 42A is advanced to a fuser 60, i.e. a fusing or fixing assembly, to fuse print image 3X to receiver 42A. Transport web 81 transports the print-image-carrying receivers 42A to fuser 60, which fixes the toner particles to the respective receivers 42A by the application of heat and pressure. The receivers 42A are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with various embodiments. For example, solvent fixing uses solvents to soften the toner particles so they bond with the receiver 42A. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver 42A.

The receivers (e.g. receiver 428) carrying the fused image (e.g., fused image 39) are transported in a series from the fuser 60 along a path either to a remote output tray 69, or back to printing modules 31, 32, 33, 34, 35, 36 to create an image on the backside of the receiver, i.e. to form a duplex print. Receivers 42B can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various media-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers 42A. This permits printer 100 to print on receivers 42 of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Various parameters of the components of a printing module (e.g., printing module 31) can be selected to control the operation of printer 100. In an embodiment, charger 21 is a corona charger including a grid between the corona wires (not shown) and photoreceptor 25. Voltage source 21*a* applies a voltage to the grid to control charging of photoreceptor 25. In an embodiment, a voltage bias is applied to toning station 23 by voltage source 23*a* to control the electric field, and thus the rate of toner transfer, from toning station 23 to photoreceptor 25. In an embodiment, a voltage is applied to a conductive base layer of photoreceptor 25 by voltage source 25*a* before development, that is, before toner is applied to photoreceptor 25 by toning station 23. The applied voltage can be zero; the base layer can be grounded. This also provides control over the rate of toner deposition during development. In an embodiment, the exposure applied by exposure subsystem 22 to photoreceptor 25 is controlled by LCU 99 to produce a latent image corresponding to the desired print image. All of these parameters can be changed, as described below.

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Figure 3A:
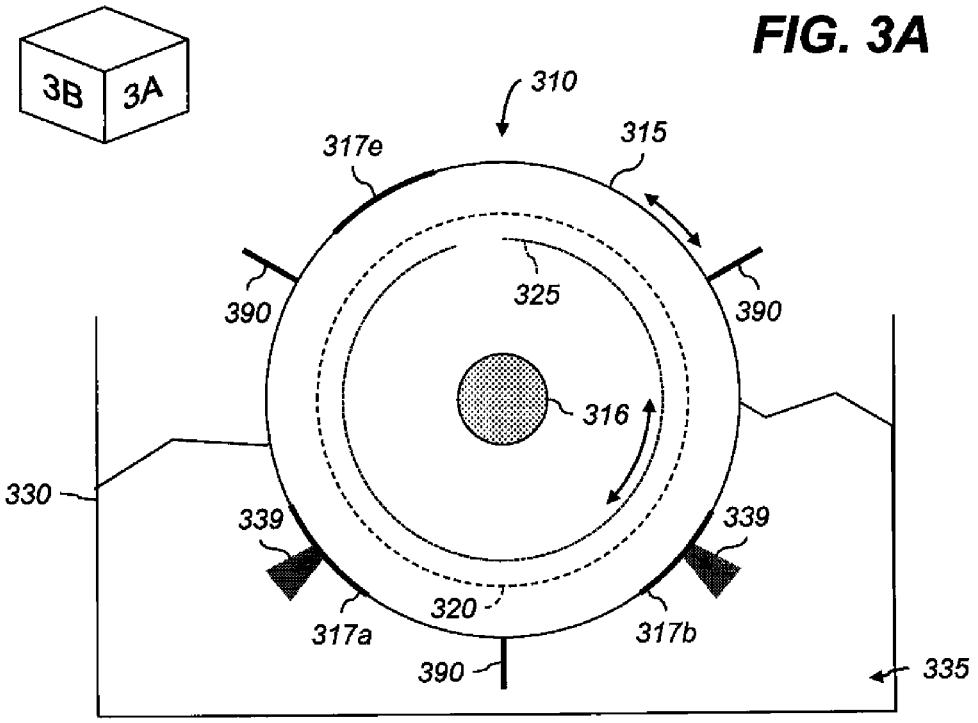
FIG. 3A is a side elevational section, and FIG. 3B a front elevational perspective, of a toner replenishment apparatus for a dry electrophotographic (EP) printer.
Figure 3B:
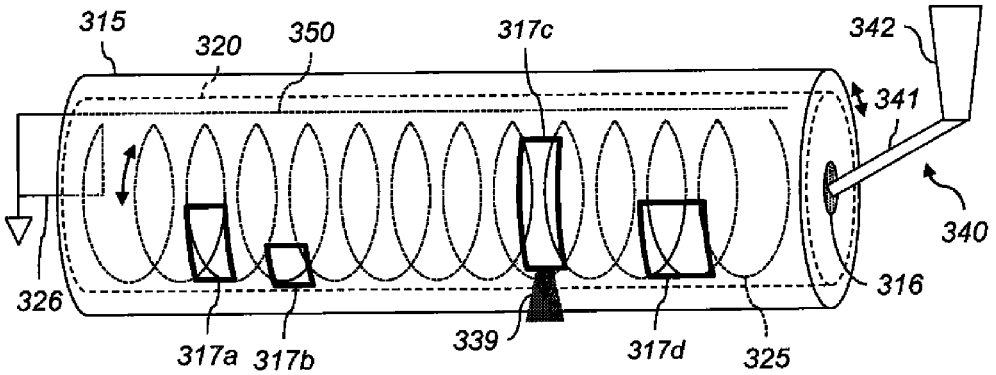

FIG. 3A is a side elevation section, and FIG. 3B a front elevational perspective, of a toner replenishment apparatus for a dry electrophotographic (EP) printer. Sump 330 holds developer 335, which includes toner particles and soft or hard magnetic carrier particles. In this figure, developer 335 is shown un-shaded for easier viewing of parts in contact with developer 335.

Toner supply 340 provides toner to channel 320. In an embodiment, shown in FIG. 3B, toner supply 340 includes reservoir 342 connected through tube 341 to channel 320 through feed port 316. In various embodiments, an auger (not shown) in tube 341 transports toner from reservoir 342 to feed port 316. In other embodiments, an automatic, normally-closed gate (not shown) is installed at the outlet of reservoir 342. When toner concentration (TC) in developer 335 in sump 330 falls below a selected threshold, as detected by a TC monitor (not shown), a controller opens the gate for a selected amount of time to permit a selected mass of toner to pass though the gate into channel 320. Examples of TC monitors useful with various embodiments include those described in U.S. Pat. No. 6,498,908 to Phillips et al., U.S. Pat. No. 4,519,696 to Bruyndonckx et al., and commonly-assigned, co-pending U.S. Ser. No. 12/847,143 by Brown et al. Toner can be drawn by gravity out of reservoir 342. In various embodiments, toner is removed from reservoir 342, or transported into sump 330, on a conveyor belt or in buckets spaced around a belt.

Rotatable transport subsystem 310 is at least partially in developer 335 in sump 330. Transport subsystem 310 includes elongated housing 315. Housing 315 includes feed port 316 and a plurality of apertures 317*a*, 317*b*, 317*c*, 317*d*, 317*e* of any shape or size arranged along its length. Apertures are indicated graphically throughout the figures with heavy lines on the perimeters of objects. The apertures 317*a*, 317*b*, 317*c*, 317*d*, 317*e* can be spaced uniformly or non-uniformly, and can be at the same or different radial positions around housing 315.

Channel 320 is within housing 315 and rotates therewith. Channel 320 receives toner from the toner supply 340 through feed port 316. In various embodiments, channel 320 is substantially circular in cross-section, i.e., has a cross-section that is circular or is elliptical and has a semi-minor axis differing by no more than ±10% from the semi-major axis.

Toner transport member 325 in channel 320 moves toner received through feed port 316 to apertures 317*a*, 317*b*, 317*c*, 317*d*, 317*e*, i.e., away from the feed port. In various embodiments, toner transport member 325 is stationary (i.e., does not rotate while housing 315 rotates) or rotates at a different angular velocity than housing 315. Either of these provides angular motion between housing 315 and toner transport member 325. In the example shown here, toner transport member 325 is a spiral wire auger arranged substantially around the inner diameter of channel 320. That is, in this example the wire auger runs just inside channel 320, near or adjacent to the wall of channel 320, the surface that contains toner in channel 320. In various embodiments, the wire auger is grounded through ground lead 326, or through a conductive element in the inside diameter of channel 320. In other embodiments, toner-transport member 325 includes a screw or auger.

Developer-mixing member 390 is attached to the outside of housing 315 for mixing toner and carrier particles in developer 335. This advantageously distributes toner more uniformly through developer 335 than would otherwise be the case. In the embodiment shown here, developer-mixing member 390 includes three paddles spaced around the outer circumference of housing 315; other numbers of paddles can be used. Other embodiments include augers, ribbon blenders, screw mixers, wire blenders, or rough-surfaced mixing rollers.

When the rotation of transport subsystem 310 brings a selected one of the apertures 317*a*, 317*b*, 317*c*, 317*d*, 317*e* below the center of housing 315 (with respect to gravity), toner passes through the selected one of the apertures 317*a*, 317*b*, 317*c*, 317*d*, 317*e*. This toner is replenishment toner 339. Replenishment toner 339 passes into developer 335 in sump 330. Replenishment toner 339 is mixed into developer 335 by developer-mixing member 390 as transport subsystem 310 rotates. Note that in FIG. 3B, for clarity, replenishment toner 339 is only shown coming from aperture 317*c*. However, replenishment toner can come from any or all of the apertures 317*a*, 317*b*, 317*c*, 317*d*, 317*e*. The number of apertures is not limited to any particular value.

In various embodiments, apertures are located at different places around housing 315. For example, referring to FIG. 3A, when the rotation of transport subsystem 310 brings a selected second one of the apertures 317*e* below the center of housing 315, replenishment toner 339 passes through the selected second aperture 317*e* into developer 335 in sump 330, and is mixed into developer 335 by developer-mixing member 390 as transport subsystem 310 rotates. In this example, the first selected one of the apertures is 317*a* or 317*b*.

In various embodiments, the radius of the circle having the same area as the opening of the selected aperture (e.g., 317*a*) is less than or equal to 10%, or ≤1%, or between 1% and 10%, of the radius of housing 315. This permits replenishment toner 339 to pass through aperture 317*a* (or whichever aperture is selected), but reduces the probability that all of the toner in channel 320 that reaches aperture 317*a* will passing through aperture 317*a*.

In some embodiments, e.g., those shown in FIG. 3A, transport subsystem 310 is at least partially out of developer 335 in sump 330. In various embodiments, housing 315 is submerged in the developer in the sump. Even if housing 315 is submerged, developer-mixing member 390 can still rise above the level of developer 335 in sump 330 as it rotates, or can also be submerged.

In some embodiments, channel 320 and housing 315 are concentric. In some embodiments, toner transport member 310 and housing 315 are concentric. The members can be concentric or not in various combinations.

Various embodiments control the charge on toner particles in channel 320 to reduce tribocharging of toner particles in channel 320. Replenishment toner 339 is preferably neutral when it passes into developer 335 so that it will mix into developer 335 more readily, and tribocharge with developer 335 more readily. Tribocharging involves the transfer of charge between toner particles and carrier particles to produce a net charge between them. The toner particles and carrier particles have different electronegativities, or are bonded to charge-control agents with different electronegativities. When particles with different electronegativities come into mechanical contact, they exchange electrons. The electronegativity of the toner particles can be greater than or less than that of the carrier particles. In various embodiments, channel 320 and toner transport member 325 are made from materials that do not substantially tribocharge the toner particles in channel 320, e.g., that do not impart charge ≥5 μC/g to the toner particles in channel 320. In other embodiments, dissipating member 350, e.g., a ground rod or grounding strap for the wire auger, is present in channel 320 to dissipate static charge on the toner particles in the channel.

Figure 4:
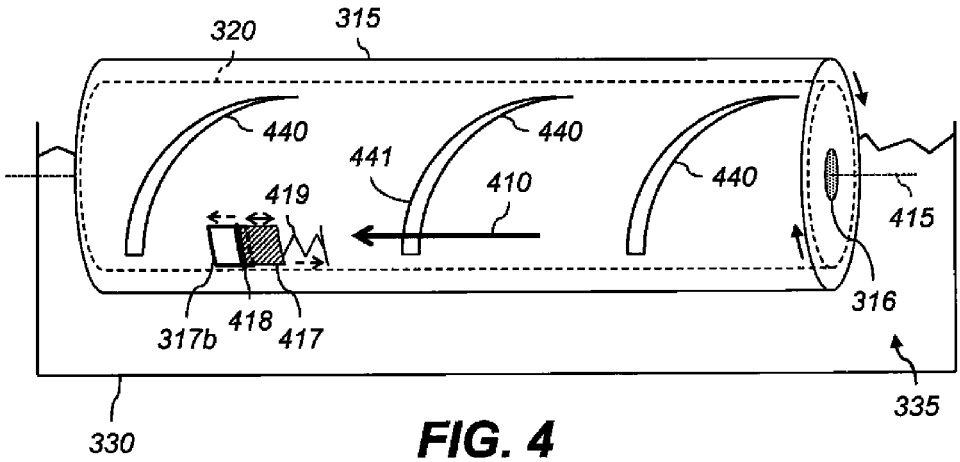
FIG. 4 shows a developer-mixing member and related components according to various embodiments.

FIG. 4 shows a developer-mixing member and related components according to various embodiments. Housing 315, channel 320, feed port 316, and aperture 317*b* are as shown in FIG. 3B. Developer-mixing member 390 (FIG. 3A, B), which can include an auger or a plurality of angled paddles 440 (shown here), drives developer 335 in sump 330 in a selected direction 410. In the example shown here, the top of housing 315 is rotating away from the viewer, so paddles 440 are driving developer 335 from right to left. Direction 410 is parallel to axis 415 of housing 315. Check valve 417, e.g., a flapper or sliding door, is provided on selected aperture 317*b*. In the example shown here, check valve 417 is a sliding door with leading edge 418 protruding out along a plane normal (perpendicular) to housing 315 into developer 335. Check valve 417 is arranged to be closed by pressure exerted by the driven developer 335 in the sump 330. In the example shown here, forces are shown with dashed arrows. The pressure exerted by developer 335 pushes leading edge 418, pulling check valve 417 closed against the force of spring 419, which holds the door open normally. Check valve 417 holds aperture 317*b* closed when a pressure wave of developer 335 passes by, then opens to release toner into developer 335 when the pressure wave has passed. This advantageously reduces the unintentional passage of developer 335 from sump 330 backwards through aperture 317*b*.

In various embodiments, developer-mixing member 390 (FIG. 3A, B) includes one or more driver(s) 441 for driving developer 335 in a selected direction 410 parallel to axis 415 of housing 315. A driver (e.g., 441) can be a paddle, wire auger, or ribbon blender. Driver 441 is upstream of selected aperture 317*b* with respect to selected direction 410. As a result, at least some developer 335 driven by driver 441 passes selected aperture 317*b*. This advantageously permits toner passing through aperture 317*b* into developer 335 to be actively mixed into the driven developer 335 passing by aperture 317*b*. In this example, driver 441 is a paddle 440.

Figure 5:
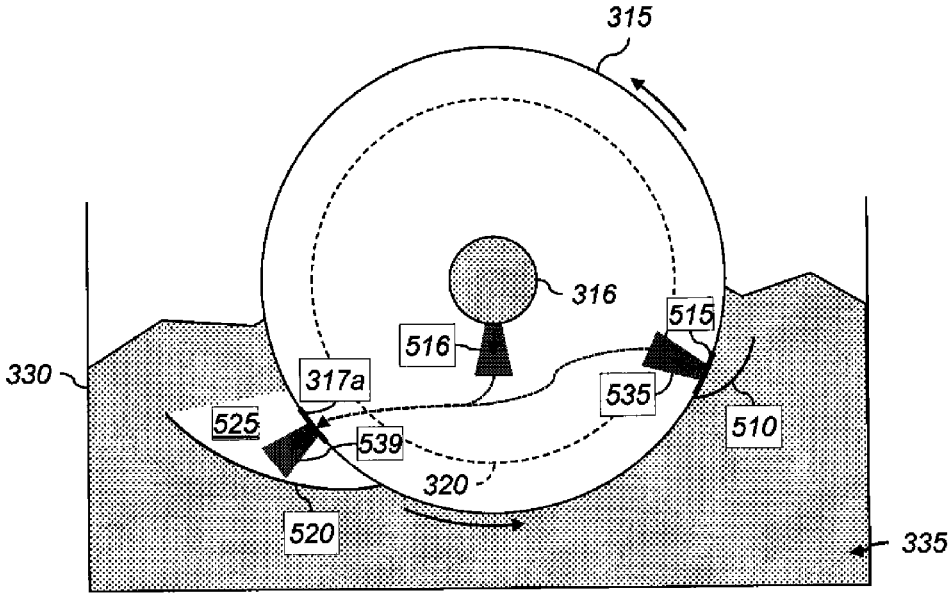
FIG. 5 shows a housing and related components according to various embodiments.

FIG. 5 shows a housing and related components according to various embodiments. Toner 516 enters channel 320 through feed port 316. Housing 315 includes scoop 510 and scoop aperture 515 for selectively capturing developer 335 from sump 330. Captured developer 535 is brought into channel 320. Deflector 520 arranged ahead of selected aperture 317*a* in the direction of rotation of housing 315 displaces developer 335 in sump 330 to produce void 525 in the developer 335 in sump 330 onto which selected aperture 317*a* opens. That is, at least some of selected aperture 317*a* is not in contact with developer 335 because it opens on void 525. In this way, as indicated by the dashed arrows, captured developer 535 is mixed with toner 516 in channel 320, and the resulting mixed developer 539 passes through selected aperture 317*a* into void 525 in developer 335.

Figure 6:
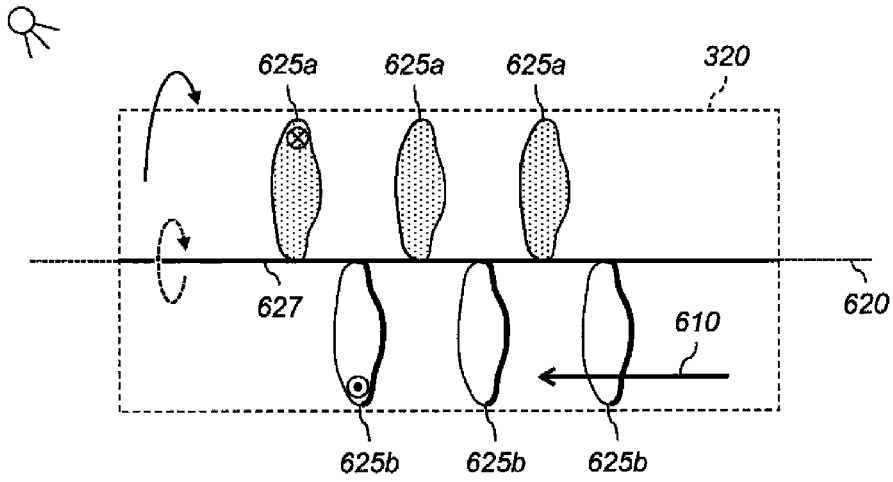
FIG. 6 is a front elevational cross-section of a toner-transport member and related components according to various embodiments.

FIG. 6 is a front elevational cross-section of a toner-transport member and related components according to various embodiments. Channel 320 is as shown in FIG. 3B. For clarity, no apertures (317, FIG. 3B) are shown. Toner-transport member 325 includes a plurality of paddles 625*a*, 625*b* arranged to drive developer in channel 320 in direction 610 parallel to axis 620 of channel 320. In this example, the paddles 625*a*, 625*b* are inclined so their faces are not everywhere perpendicular to axle 627. The faces can be curved or straight, and the paddles can be of any shape or inclination effective to drive developer. Paddles 625*a*, 625*b* can be mounted on axle 627 or in grooves or races or on protruding rings in the inner surface of channel 320.

In this example, axle 627 is rotating so the paddles 625*a* above axis 627 are moving into the page and those below axis 627 are moving out of the page, as indicated by the dashed arrow and by the the vector symbols. The trailing faces of paddles 625*a* and the leading faces of paddles 625*b* are visible. Shading in this figure is for light coming from the upper-left corner, as shown. The heavy edge of each paddle 625*b* represents the leading edge of that paddle, which edge is closest to the viewer. Each paddle 625*a* is shaded because the trailing edge (left-hand edge) for paddles 625*a* above axle 627 is closest to the viewer, so paddles 625*a* recede from left to right and are in shadow.

Figure 7:
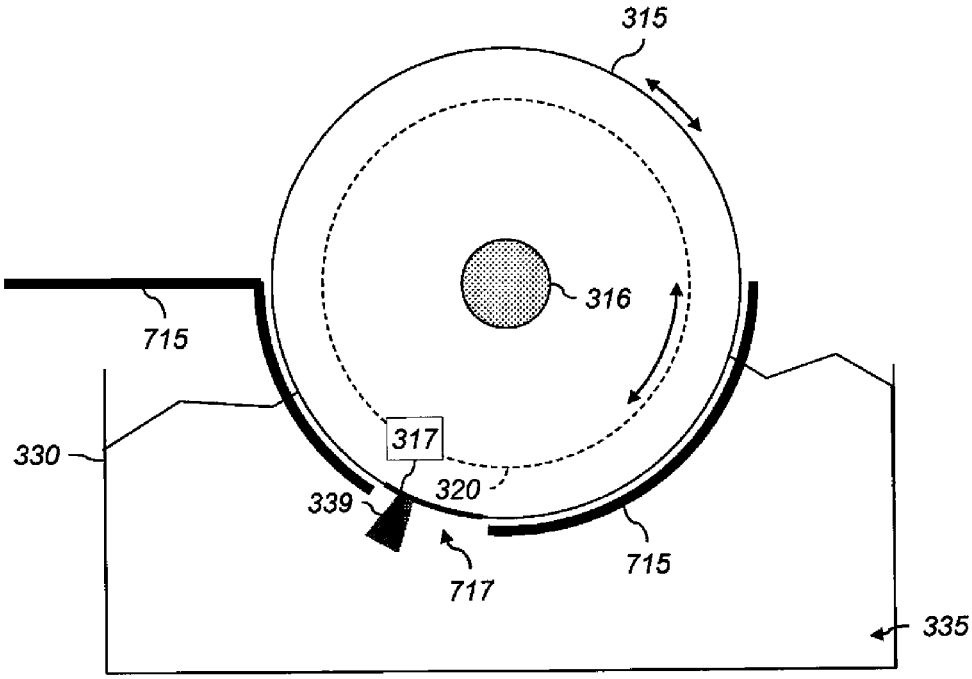
FIG. 7 is a side elevational cross-section of a support and related components according to various embodiments.

FIG. 7 is a side elevational cross-section of a support and related components according to various embodiments. Feed port 316 is as shown in FIG. 3A. Support 715 holds housing 315 at least partially out of developer 335 in sump 330. In this cross-section, two sections of support 715 are labeled individually for clarity. Support 715 can include one member with holes or other apertures in it, or a plurality of members. Support 715 includes aperture 717 aligned with the selected aperture 317 along the length of housing 315. That is, aperture 717 has substantially the same position as aperture 317 along axis 415 (FIG. 6) of housing 315. Replenishment toner 339 therefore passes through selected aperture 317 and aperture 717 of support 715 when those apertures are brought into alignment by the rotation of the housing 315. Aperture 717 in support 715 serves as a gate to meter a desired amount of replenishment toner 339 into developer 335 each revolution of housing 315. If support 715 includes a plurality of members, aperture 717 can be an opening in a selected one of those members, or an opening formed by two or more adjacent members.

Figure 8:
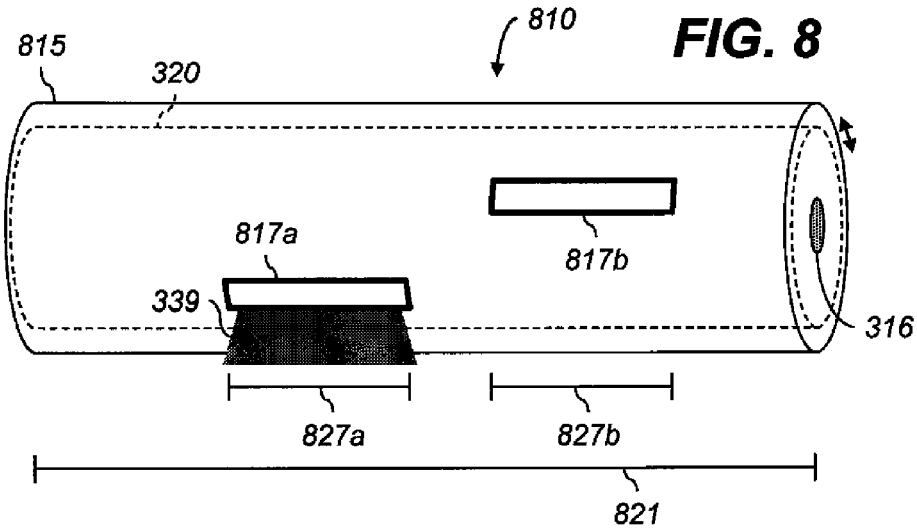
FIG. 8 is a front elevational perspective of toner replenishment apparatus for a dry EP printer according to various embodiments.

FIG. 8 is a front elevational perspective of toner replenishment apparatus for a dry EP printer according to various embodiments. Sump 330 (FIG. 3A) holds developer 335 (FIG. 3A) including toner particles and magnetic carrier particles. Toner supply 340 (FIG. 3B) supplies toner. Rotatable transport subsystem 310 (FIG. 3B) is disposed at least partially in developer 335 in sump 330. Transport subsystem 810 includes elongated housing 815 including feed port 316 and one or more slits 817*a*, 817*b* arranged along the length of housing 815. Channel 320 within housing 815 is adapted to receive toner from toner supply 340 (FIG. 3B) through feed port 316. The one or more slit(s) 817*a*, 817*b* together span at least 25% of length 821 of channel 320. In this example, the lengths of slits 817*a*, 817*b* are lengths 827*a*, 827*b* respectively. For $L_x$=the length of part x, $$(L_{827a}+L_{827b})/L_{821}\geq 0.25$$

One slit can be that long, or multiple slits together can. The slits do not have to be adjacent or coaxial. Toner transport member 325 (FIG. 3B) in channel 320 moves toner received through feed port 316 to slit(s) 817*a*, 817*b*, as described above. Developer-mixing member 390 (FIG. 3A) is attached to the outside of housing 815 for mixing toner and carrier particles in the developer. When the rotation of transport subsystem 810 brings a selected one of the slit(s), e.g., slit 817*a*, below the center of the housing, replenishment toner 339 passes through the selected slit 817*a* into developer 335

(FIG. 3A) in sump 330 (FIG. 3A), and is mixed into the developer by the developer-mixing member 390 as the transport subsystem 810 rotates.

Figure 9:
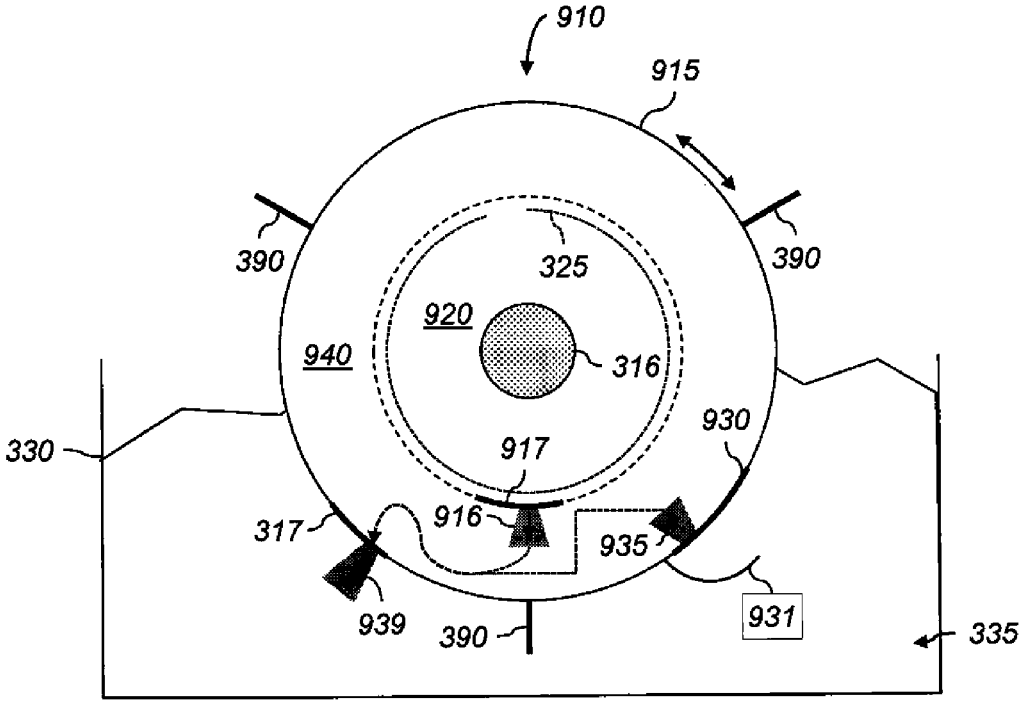
FIG. 9 is a side elevational section of a toner replenishment apparatus for a dry electrophotographic (EP) printer according to various embodiments.

FIG. 9 is a side elevational section of a toner replenishment apparatus for a dry electrophotographic (EP) printer according to various embodiments. Sump 330, developer 335, and developer-mixing member 390 are as shown in FIGS. 3A and 3B. Rotatable transport subsystem 910 is arranged at least partially in the developer in the sump. Elongated housing 915 includes feed port 316 and one or more apertures (only one, aperture 317, is shown) corresponding to those shown in FIG. 3A. Housing 915 also includes developer port 930.

Channel 920 within housing 915 receives toner from toner supply 340 (not shown in this figure) through feed port 316. Channel 920 includes a plurality of delivery apertures 917 arranged along its length; as this figure is an end view, only one delivery aperture 917 is shown.

Toner transport member 325 in channel 920 moves toner received through feed port 316 to delivery apertures 917. Toner transport member 325 is as described above with reference to FIGS. 3A and 3B.

Mixing chamber 940 in housing 915 receives toner from channel 920 through one or more of the delivery apertures 917 and developer 335 from sump 330 through developer port 930. In this example, developer port 930 has scoop 931 to draw developer 335 into mixing chamber 940, as indicated by the dashed arrows; other embodiments can be used. The rotation of transport subsystem 910 mixes received toner 916 into received developer 935 to provide mixed developer 939. This advantageously pre-mixes toner into developer, which reduces dusting and can improve TC uniformity in developer 335.

When the rotation of transport subsystem 910 brings a selected one of the apertures 317 below the center of housing 915, mixed developer 939 from mixing chamber 940 passes through selected aperture 317 into developer 335 in sump 330, and is mixed into developer 335 by developer-mixing member 390 as transport subsystem 910 rotates.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

21 charger
21*a* voltage source
22 exposure subsystem
23 toning station
23*a* voltage source
25 photoreceptor
25*a* voltage source
31, 32, 33, 34, 35, 36 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
210 toning roller
214 metering skive
217 toning zone
220 feed roller
225 protrusions
230 sump
235 developer
237 mixer
238 tube
239 replenishment toner
310 transport subsystem
315 housing
316 feedport
317, 317*a*, 317*b*, 317*c*, 317*d*, 317*e* aperture
320 channel
325 toner transport member
326 ground lead
330 sump
335 developer
339 replenishment toner
340 toner supply
341 tube
342 reservoir
350 dissipating member
390 developer-mixing member
410 direction
415 axis
417 check valve
419 spring
418 leading edge
440 paddle
441 driver
510 scoop
515 scoop aperture
516 toner
520 deflector
525 void
535 captured developer
539 mixed developer
610 direction
620 axis
625*a*, 625*b* paddles
627 axle
715 support
717 aperture
810 transport subsystem
815 housing
817*a*, 817*b* slit
821 length
827*a*, 827*b* length
910 transport subsystem
915 housing

916 received toner
917 delivery aperture
920 channel
930 developer port
931 scoop
935 received developer
939 developer
940 mixing chamber

The invention claimed is:

1. Toner replenishment apparatus for a dry electrophotographic (EP) printer, comprising:

a. a sump for holding developer, the developer including toner particles and magnetic carrier particles;

b. a toner supply;

c. a rotatable transport subsystem at least partially in the developer in the sump and including:

i. an elongated housing including a feed port and a plurality of apertures arranged along its length;

ii. a channel within the housing adapted to receive toner from the toner supply through the feed port;

iii. a toner transport member in the channel for moving toner received through the feed port to the apertures, wherein the toner transport member is stationary or rotates at a different angular velocity than the housing; and iv. a developer-mixing member attached to the outside of the housing for mixing toner and carrier particles in the developer;

d. means for causing the rotation of the transport subsystem so as to brings a selected one of the apertures below the center of the housing as toner passes through the selected aperture into the developer in the sump, and is mixed into the developer by the developer-mixing member as the transport subsystem rotates; and e. a support for holding the housing at least partially out of the developer in the sump, the support including an aperture aligned with the selected aperture along the length of the housing, so that toner passes through the selected aperture and the aperture of the support when they are brought into alignment by the rotation of the housing.

2. The apparatus according to claim 1, wherein when the rotation of the transport subsystem brings another one of the apertures below the center of the housing, toner passes through the selected second aperture into the developer in the sump, and is mixed into the developer by the developer-mixing member as the transport subsystem rotates.

3. The apparatus according to claim 1, wherein the transport subsystem is at least partially out of the developer in the sump.

4. The apparatus according to claim 1, wherein the housing is submerged in the developer in the sump.

5. The apparatus according to claim 1, wherein the channel and the housing are concentric.

6. The apparatus according to claim 1, wherein the toner transport member and the housing are concentric.

7. The apparatus according to claim 1, wherein the toner transport member includes a wire auger arranged substantially around the inner diameter of the channel.

8. The apparatus according to claim 7, wherein the wire auger is grounded.

9. The apparatus according to claim 1, wherein the toner-transport member includes a screw or auger.

10. The apparatus according to claim 1, wherein the toner-transport member includes a plurality of paddles arranged to drive developer in the channel in a direction parallel to the axis of the channel.

11. The apparatus according to claim 1, wherein the channel is substantially circular in cross-section.

12. The apparatus according to claim 1, wherein the radius of a circle having the same area as the opening of the selected aperture is less than or equal to 10% of the radius of the housing.

13. The apparatus according to claim 1, wherein the developer-mixing member includes a driver for driving developer in a selected direction parallel to the axis of the housing, the driver being upstream of the selected aperture with respect to the selected direction.

14. The apparatus according to claim 1, wherein the channel and the toner-transport member are made from materials that do not substantially tribocharge the toner particles in the channel.

15. The apparatus according to claim 1, further including a dissipating member for dissipating static charge on the toner particles in the channel.

16. Toner replenishment apparatus for a dry electrophotographic (EP) printer, comprising:

a. a sump for holding developer, the developer including toner particles and magnetic carrier particles;

b. a toner supply;

c. a rotatable transport subsystem at least partially in the developer in the sump and including:

i. an elongated housing including a feed port and a plurality of apertures arranged along its length;

ii. a channel within the housing adapted to receive toner from the toner supply through the feed port;

iii. a toner transport member in the channel for moving toner received through the feed port to the apertures, wherein the toner transport member is stationary or rotates at a different angular velocity than the housing; and iv. a developer-mixing member attached to the outside of the housing for mixing toner and carrier particles in the developer;

d. means for causing the rotation of the transport subsystem so as to bring a selected one of the apertures below the center of the housing as toner passes through the selected aperture into the developer in the sump, and is mixed into the developer by the developer-mixing member as the transport subsystem rotates; and e. wherein the developer-mixing member drives developer in the sump in a selected direction parallel to the axis of the housing, and further comprising a check valve on the selected aperture arranged to be closed by pressure exerted by the driven developer in the sump.

17. Toner replenishment apparatus for a dry electrophotographic (EP) printer, comprising:

a. a sump for holding developer, the developer including toner particles and magnetic carrier particles;

b. a toner supply;

c. a rotatable transport subsystem at least partially in the developer in the sump and including:

i. an elongated housing including a feed port and a plurality of apertures arranged along its length;

ii. a channel within the housing adapted to receive toner from the toner supply through the feed port;

iii. a toner transport member in the channel for moving toner received through the feed port to the apertures, wherein the toner transport member is stationary or rotates at a different angular velocity than the housing; and iv. a developer-mixing member attached to the outside of the housing for mixing toner and carrier particles in the developer;

d. means for causing the rotation of the transport subsystem so as to bring a selected one of the apertures below the center of the housing as toner passes through the selected aperture into the developer in the sump, and is mixed into the developer by the developer-mixing member as the transport subsystem rotates; and e. wherein the housing further includes a scoop for selectively capturing developer from the sump and bringing the captured developer into the channel and a deflector arranged ahead of the selected aperture in the direction of rotation of the housing to displace developer to produce a void in the developer in the sump onto which the selected aperture opens, so that the captured developer is mixed with toner in the channel and the mixed developer passes through the selected aperture into the void.

* * * * *